US007237772B2

(12) United States Patent
Kamamura

(10) Patent No.: US 7,237,772 B2
(45) Date of Patent: Jul. 3, 2007

(54) IMAGE FORMING APPARATUS WITH CONTROL OF SHEET CARRIER TO COMPENSATE FOR SHEET CONVEYING DISTANCE

(75) Inventor: Takuya Kamamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 10/830,012

(22) Filed: Apr. 23, 2004

(65) Prior Publication Data

US 2004/0217538 A1 Nov. 4, 2004

(30) Foreign Application Priority Data

May 1, 2003 (JP) ..... 2003-126448

(51) Int. Cl.
*B65H 3/44* (2006.01)

(52) U.S. Cl. ..... 271/9.01; 271/9.05; 271/9.13; 271/258.01; 271/270

(58) Field of Classification Search ..... 271/9.01, 271/9.05, 9.13, 242, 256, 258.01, 266, 270; 399/388, 391, 395, 396
See application file for complete search history.

(56) References Cited

U.S. PATENT DOCUMENTS 5,612,776 A * 3/1997 Machino et al. ..... 399/43
6,526,253 B2 * 2/2003 Hayashi et al. ..... 399/391
2003/0202812 A1 10/2003 Kawamura ..... 399/67

FOREIGN PATENT DOCUMENTS

JP 2002-29649 1/2002

* cited by examiner

*Primary Examiner*—David H. Bollinger
(74) *Attorney, Agent, or Firm*—Fitzpatrick, Cella, Harper & Scinto

(57) ABSTRACT

An image forming apparatus has an image former for forming an image on a sheet at a predetermined image-forming speed; a plurality of feeders; a carrier for carrying the sheet fed from either of the feeders to the image former; and a controller for controlling the carrier to suspend the sheet fed from either of the feeders at a first position upstream of the image former. The controller determines whether a subsequent sheet is suspended at a second position upstream of the first position and/or controls a speed at which the carrier carries the sheet, based on a feeder that feeds the sheet among the plurality of feeders and/or on the image-forming speed of the image former.

16 Claims, 7 Drawing Sheets

IMAGE FORMING APPARATUS WITH CONTROL OF SHEET CARRIER TO COMPENSATE FOR SHEET CONVEYING DISTANCE

BACKGROUND OF THE INVENTION

1. Field of the Invention

The present invention relates to an image forming apparatus such as a multifunction copier or a printer and, more particularly, to the paper-feed control of an image forming apparatus.

2. Description of the Related Art

Image forming apparatuses typically have countermeasures to prevent a paper jam. Particularly, when a sheet of paper is fed out from a paper feeder for paper feeding, the sheet of paper can accidentally slip from a carrier path because sufficient carrying power is not transmitted to the sheet of paper, unlike a case where the sheet of paper is held by a carrier roller. In order to overcome the above drawback, a control method is adopted in which the paper feeding is started as soon as possible and the sheet of paper is carried as fast as possible. With this method, even when the fed sheet of paper slips from the carrier path and is delayed, the sheet of paper can arrive at a registration unit within a predetermined time period.

The registration unit suspends the sheet of paper in a state where the sheet of paper impinges against a pair of registration rollers that are stopped, and then restarts rotation of the registration rollers in synchronism with imaging on a photoconductive drum (registration-on) to carry the sheet of paper to the photoconductor drum, in order to align the sheet of paper with an image formed on the photoconductive drum.

If the sheet of paper arrives at the registration unit too early, a subsequent sheet of paper strikes the trailing end of a preceding sheet of paper that is stopped in the registration unit. As a countermeasure against this, a method is known in which the sheet of paper is fed at a speed higher than a processing speed that is used in imaging and transfer, and the subsequent sheet of paper is carried to the registration unit only after the subsequent sheet of paper is stopped at an upstream position of the registration unit before the leading end of the subsequent sheet of paper catches and strikes the trailing end of the preceding sheet of paper stopped at the registration unit. Feeding the sheet of paper at a speed higher than the processing speed is referred to as increased-speed paper feeding. Suspending the subsequent sheet of paper upstream of the registration unit is referred to as pre-registration stop (for example, Japanese Patent Application Publication No. 2002-29649).

Although FIGS. 3 and 4 are diagrams illustrating an embodiment of the present invention, the pre-registration stop will be described below by incorporating FIGS. 3 and 4 by reference.

FIG. 3 illustrates an example of the increased-speed paper feeding and the pre-registration stop. A vertical axis 3001 represents a position of a sheet of paper with respect to the registration rollers. A horizontal axis 3002 represents time. Reference numeral 3003 denotes a registration position. Reference numeral 3004 denotes a pre-registration stop position. Reference numeral 3005 denotes the position of a pre-registration sensor. Stopping of the sheet of paper and creating a loop at the registration position are performed with respect to the position 3005. Reference numeral 3006 denotes a position of a vertical-path lower sensor. Stopping of the sheet of paper at the pre-registration stop position is performed with respect to the position 3006. Reference numeral 3007 denotes the paper-feed starting time of a preceding sheet of paper. Reference numeral 3008 denotes the paper-feed starting time of a subsequent sheet of paper. Reference numeral 3009 denotes a segment showing how the leading end of the preceding sheet of paper proceeds and reference numeral 3010 denotes a segment showing how the leading end of the subsequent sheet of paper proceeds. Reference numeral 3011 denotes a segment showing how the trailing end of the preceding sheet of paper proceeds and reference numeral 3012 denotes a segment showing how the trailing end of the subsequent sheet of paper proceeds. The variation in the inclination before and after the registration position 3003 shows that the speed of the sheet of paper before the registration is different from the speed thereof after the registration. The speed after the registration is the processing speed and the speed before the registration is an increased-paper-feed speed.

Reference numeral 3015 denotes a time period during which registration-on is performed. The distance corresponding to the time period 3015 corresponds to an interval at which the sheet of paper is fed to the registration unit. Reference numeral 3016 denotes a pre-registration-stop time period. When the sheet of paper is delayed due to slip during paper feeding, shortening the pre-registration-stop time period 3016 can eliminate the delay during paper feeding, thus minimizing the delay of the sheet of paper at the registration unit.

However, applying the known increased-speed paper feeding and pre-registration stop technology to recent printers that feed sheets of paper at short intervals in order to achieve a high productivity has caused the following problems.

When the paper-feed starting position is sufficiently apart from the registration position as shown in FIG. 3, no problem is caused if the sheet of paper is fed at shorter intervals. However, there are cases in which the paper-feed starting position is near the registration position. For example, in an image forming apparatus provided with a plurality of paper cassettes at the lower part of a printer, the distance between the paper-feed starting position and the registration position varies from cassette to cassette. The paper-feed starting position of a top paper cassette is nearest to the registration position. The paper-feed starting position that is not sufficiently apart from the registration position causes the following problems.

The same parts as in FIG. 3 are not described in the description with reference to FIG. 4 and the reference numerals in FIG. 4 shall have the same meanings as described above in FIG. 3. Reference numeral 4001 denotes a vertical-path upper sensor, which is a reference sensor for the pre-registration stop with respect to the paper-feed starting position that is nearer to the registration position than the paper-feed starting position in FIG. 3. Reference numeral 4002 denotes the paper-feed starting time of a preceding sheet of paper. Reference numeral 4003 denotes the paper-feed starting time of a subsequent sheet of paper. The time interval between 4002 and 4003 is the same as that between 3007 and 3008 in FIG. 3 and, therefore, the paper feeder in FIG. 3 has the same productivity as the paper feeder in FIG. 4. Referring to FIG. 4, the trailing end of the preceding sheet of paper intersects the leading end of the subsequent sheet of paper at a position 4005. In other words, since the paper-feed starting position is near the registration position, the leading end of the subsequent sheet of paper catches the trailing end of the preceding sheet of paper carried at the processing speed because the subsequent sheet of paper is fed at the increased-paper-feed speed before reaching the pre-registration stop. When the paper-feed starting time is delayed in order to solve the above problem, the productivity cannot be maintained unless a pre-registration-stop time period 4004 is shortened. Shortening the pre-registration-stop time period is likely to cause a paper jam due to the delay. Furthermore, a pre-registration-stop time period that is too short can cause a carrier motor in the pre-registration unit to be out of synchronization with control pulses, thus disadvantageously causing paper jam.

SUMMARY OF THE INVENTION

It is an object of the present invention to stably feed and carry sheets of paper until the registration, independent of a paper feeder, even in an image forming apparatus feeding the sheets of paper at short intervals for achieving a higher productivity.

The present invention provides an image forming apparatus including an image former, a plurality of paper feeders, a carrier, and a controller. The image former forms an image on a sheet of paper at a predetermined image-forming speed. The multiple paper feeders each positioned a different sheet-of-paper-carrying distance to the image former. The carrier carries the sheet of paper fed from any of the plurality of paper feeders to the image former. The controller controls the carrier to suspend feeding of the sheet of paper fed from either of the plurality of paper feeders at a first position upstream of the image former. The controller determines whether feeding of a subsequent sheet of paper is suspended at a second position upstream of the first position and/or controls a speed at which the carrier carries the sheet of paper, based on a paper feeder that feeds the sheet of paper among the plurality of paper feeders and/or on the image-forming speed of the image former.

According to the embodiments of the present invention, it is possible to stably feed and carry the sheets of paper until registration, independent of the paper feeder, even in the image forming apparatus, having a high productivity, in which the sheets of paper are fed at short intervals. Since a known pre-registration-stop-type increased-speed paper feeding is performed for the paper feeder capable of the increased-speed paper feeding accompanied by the pre-registration stop, the paper feeders and components in the carrier path are compatible with those in a known image forming apparatus, thus saving the cost and being useful with the object of recycling.

Further objects, features and advantages of the present invention will become apparent from the following description of the preferred embodiments with reference to the attached drawings.

DESCRIPTION OF THE PREFERRED EMBODIMENTS

Figure 1:
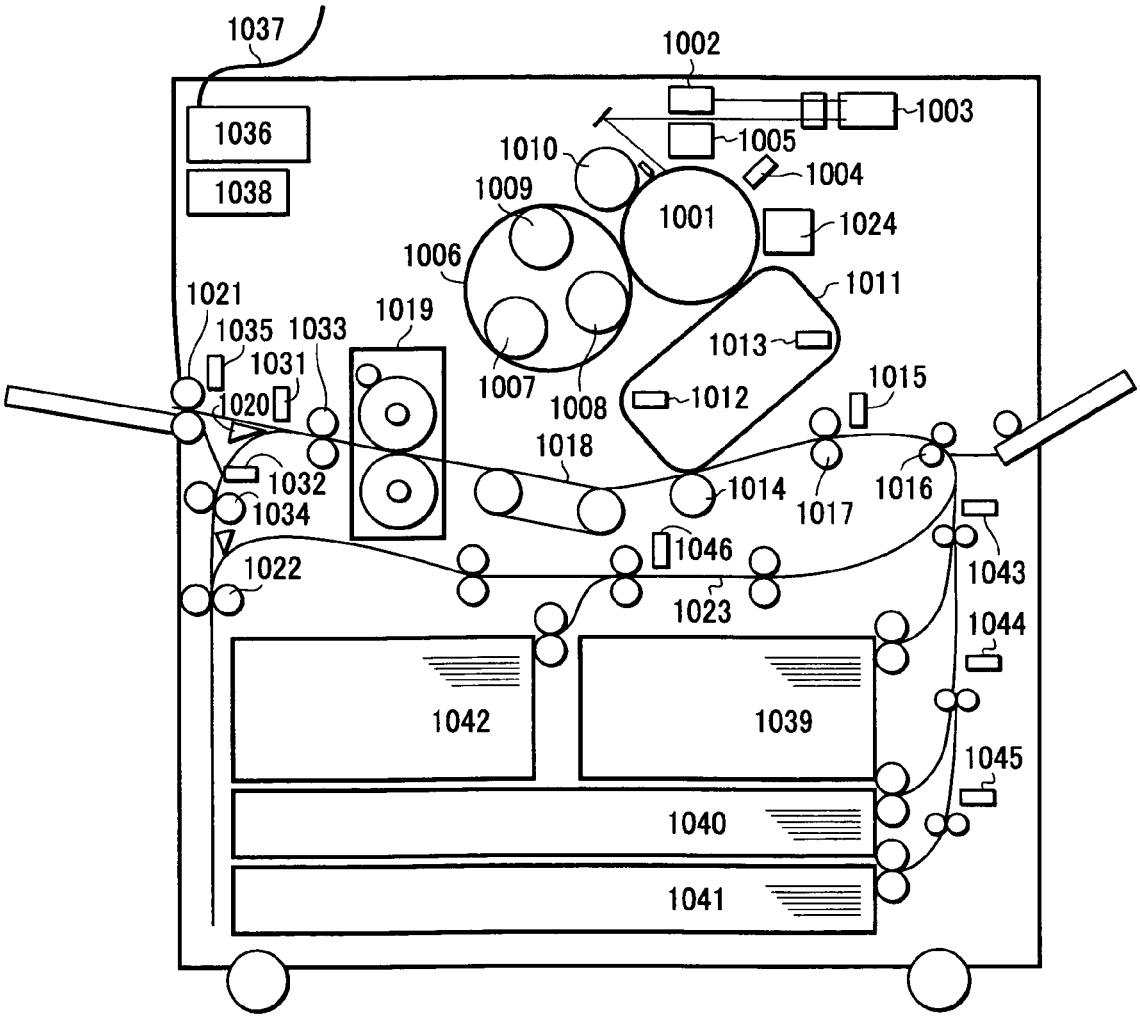
FIG. 1 is a cross-sectional view showing the structure of an image forming apparatus according to an embodiment of the present invention.

FIG. 1 is a cross-sectional view showing the structure of an image forming apparatus according to an embodiment of the present invention.

Referring to FIG. 1, a processor 1036 processes image data in the image forming apparatus. The processor 1036 expands page description language (PDL) data supplied from a host computer into an image, and supplies the image data and a print control command to an image former. The processor 1036 also supplies an image from an image reader (not shown) to the image former. A network cable 1037 connects the processor 1036 to a network. The network cable 1037 may be a printer cable that connects the processor 1036 to the host computer. A controller 1038 controls components, described below, in the image forming apparatus to perform printing.

The image forming apparatus of this embodiment further includes a photoconductor drum 1001, a laser unit 1002, a polygon mirror 1003, a pre-exposure unit 1004, a primary charger 1005, a developing rotary 1006, a magenta-developer (M-developer) unit 1007, a yellow-developer (Y-developer) unit 1008, a cyan-developer (C-developer) unit 1009, a black-developer (K-developer) unit 1010, an intermediate transfer belt (ITB) 1011, and ITB home-position sensors 1012 and 1013. The laser unit 1002 is an exposure light source for forming a latent image. The polygon mirror 1003 scans laser beams. The pre-exposure unit 1004 eliminates excess charges on the photoconductor drum 1001. The primary charger 1005 electrically charges the photoconductor drum 1001. The photoconductor drum 1001, electrically charged by the primary charger 1005, is exposed to laser beams modulated in the laser unit 1002 for forming an electrostatic image. The M-developer unit 1007 develops the electrostatic image on the photoconductor drum 1001 with magenta toner, magenta being a primary color. The Y-developer unit 1008 develops the electrostatic image on the photoconductor drum 1001 with yellow toner, yellow being a secondary color. The C-developer unit 1009 develops the electrostatic image on the photoconductor drum 1001 with cyan toner, cyan being a tertiary color. The magenta-developer unit 1007, the yellow-developer unit 1008, and the cyan-developer unit 1009 are included in the developing rotary 1006. The K-developer unit 1010 develops the electrostatic image on the photoconductor drum 1001 with black toner, black being a quaternary color. The toner image on the photoconductor drum 1001 is primarily transferred to the ITB 1011. The ITB home-position sensor 1012 is arranged away from the ITB home-position sensor 1013 by a half-perimeter of the ITB 1011. Although the image forming apparatus of this embodiment uses the two ITB home-position sensors 1012 and 1013, one ITB home-position sensor may be structured so as to output a half-rotation signal when the ITB home-position sensor detects an ITB home position and when the ITB 1011 rotates by a half-perimeter thereof from the ITB home position.

After the four-color toner images are superposed on the ITB 1011, a secondary transfer roller 1014 secondarily transfers the superposed toner image on the ITB 1011 to a sheet of paper. The sheet of paper is fed from one of paper feeders 1039, 1040, 1041, and 1042. Reference sensors 1043, 1044, 1045, and 1046 for pre-registration stop or for decreased-speed paper feeding correspond to the paper feeders 1039, 1040, 1041, and 1042, respectively. The image forming apparatus further includes a vertical-path combining roller 1016, a registration roller 1017, and a pre-registration sensor 1015. The sheet of paper fed from the paper feeder 1039, 1040, 1041, or 1042 passes through the vertical-path combining roller 1016 and waits for an event at an imaging side (at the ITB side) while impinging against the registration rollers 1017 that are stopped. The sheet of paper is then registered in synchronous with the toner image on the ITB 1011, so that the sheet of paper arrives at the secondary transfer roller 1014 simultaneously with the toner image on the ITB 1011, thus transferring the toner image on the sheet of paper without deviation. A cleaner 1024 removes residual toner on the photoconductor drum 1001 after the primary transfer.

A carrier belt 1018 carries the sheet of paper downstream after the secondary transfer. A fixing unit 1019 fixes the toner image transferred to the sheet of paper on the sheet of paper. A flapper 1020 at a branch point feeds the sheet of paper to a paper-output roller 1021 when the sheet of paper on which the toner image is fixed is to be output outside the apparatus, and otherwise feeds the sheet of paper to an inversion path. A branch sensor 1031 at the branch point corresponds to a primary sensor. A paper-output roller 1033 drags the sheet of paper supplied from the fixing unit 1019 into a branch path. A paper-output roller 1021 for an external paper-output path outputs the sheet of paper on which the toner image is fixed to a tray outside the apparatus. The sheet of paper is output to the tray outside the apparatus at a timing that is determined based on a paper-output sensor 1035. The inversion path includes an inversion roller 1022, an inversion vertical-path sensor 1032, and an inversion vertical-path roller 1034. The inversion vertical-path roller 1034, together with the inversion roller 1022, drags the sheet of paper into the inversion path. The paper-output roller 1033, which has a one-way function, allows the inversion vertical-path roller 1034 to drag the sheet of paper into the inversion path at a speed higher than the rotation speed of the paper-output roller 1033. Accordingly, the sheet of paper can be drawn into the inversion path at an accelerated speed while the trailing end of the sheet of paper is held in the paper-output roller 1033.

During double-sided printing, the inversion roller 1022 feeds the sheet of paper in switchback style to invert the sheet of paper. A double-sided carrier path 1023 carries the sheet of paper inverted in the inversion path to the vertical-path combining roller 1016 again for backside printing. The double-sided carrier path 1023 also functions as a paper-feed and carrier path when the sheet of paper is fed from the left-deck paper feeder 1042.

The one-way function of the paper-output roller 1033 is effective in the output of the sheet of paper. Specifically, as long as the trailing end of the sheet of paper held in the paper-output roller 1021 passes through the fixing unit 1019, even if the trailing end of the sheet of paper does not pass through the paper-output roller 1033, it is possible to increase the speed of a paper-output motor for driving the paper-output roller 1021.

Figure 2:
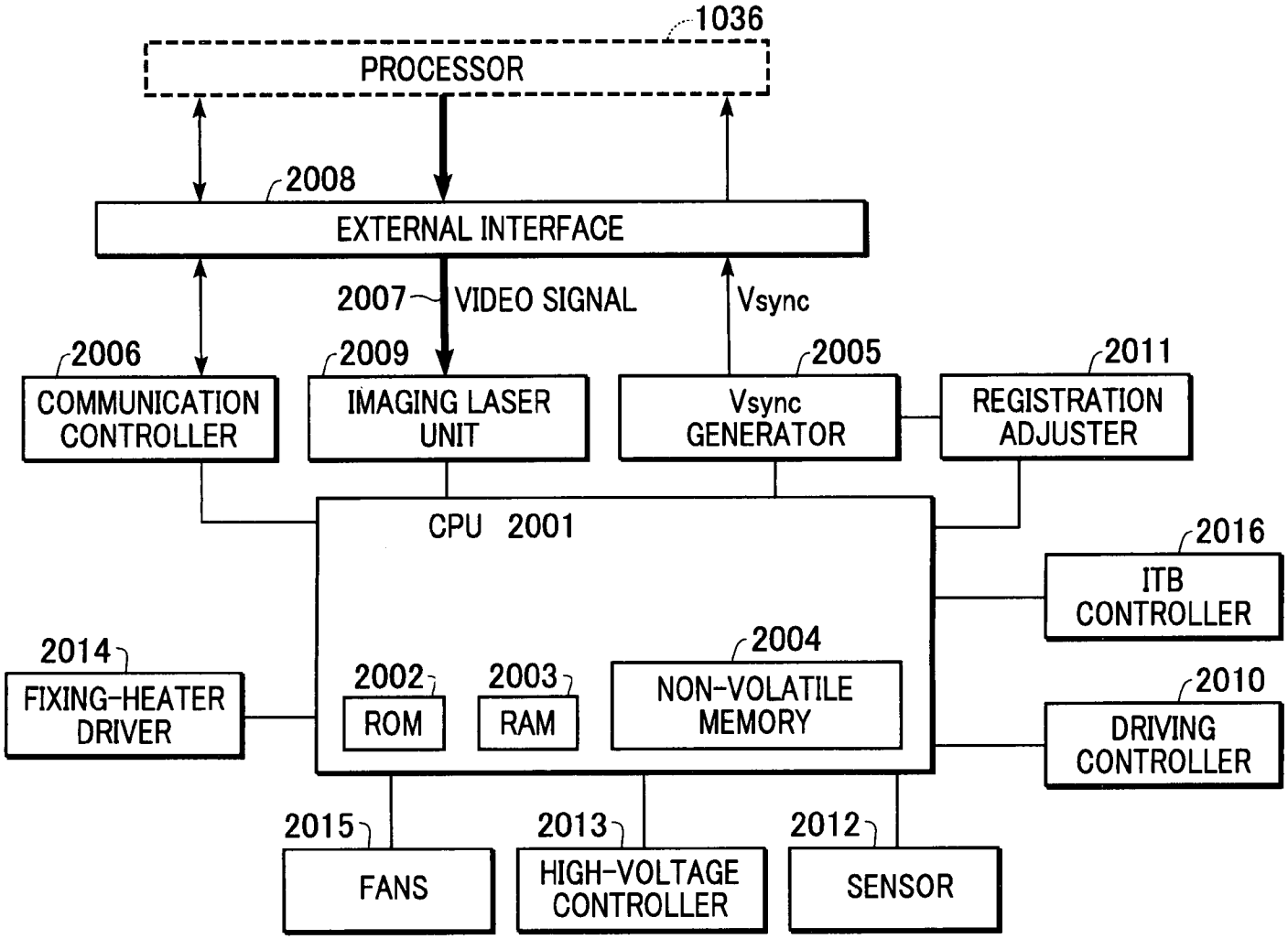
FIG. 2 is a block diagram showing the structure of a controller in the image forming apparatus of this embodiment.

FIG. 2 is a block diagram showing the structure of a controller in the image forming apparatus of the present embodiment.

Referring to FIG. 2, a central processing unit (CPU) 2001 controls the overall image forming apparatus. A ROM 2002 stores a control program. A RAM 2003 is used as a work area in the controller. A non-volatile memory 2004 stores various adjustment values. A vertical-synchronization-signal (Vsync) generator 2005 synchronizes image signals with an image inputting apparatus. A communication controller 2006 controls command communication with external equipment such as a scanner. The image data synchronized by the Vsync generator 2005 is transferred from the scanner to the image forming apparatus through a video-signal line 2007. An external interface 2008 interfaces with the processor 1036 in FIG. 1.

An imaging laser unit 2009 irradiates the photoconductor drum 1001 with a laser beam based on the image data received through the video-signal line 2007. A driving controller 2010 controls various drivers such as a motor. The driving controller 2010 specifically controls a fixing motor for rotating the paper-output roller 1033 and a fixing roller of the fixing unit 1019, an inverting motor for rotating the inversion vertical-path roller 1034 and the inversion roller 1022, a paper-feed and carrier motor for rotating each roller in the paper-feeding system in the image forming apparatus, and so on.

A registration adjuster 2011 generates a registration-on signal in synchronous with the driving controller 2010, and transfers the toner image to a desired position on the sheet of paper.

Sensors 2012 include a carrier sensor, an environmental sensor, the branch sensor 1031 at the branch point, the inversion vertical-path sensor 1032, and sensors in use for feeding and carrying the sheet of paper. Signals output from a carrier sensor, such as the branch sensor 1031 or the inversion vertical-path sensor 1032, are masked so as to be effective only during a predetermined time period each time the sheet of paper is scheduled to pass through, instead of being constantly monitored by the CPU 2001. Accordingly, the CPU 2001 can accurately detect the leading end of the sheet of paper.

The controller in the image forming apparatus also includes a high-voltage controller 2013, a fixing-heater driver 2014, various fans 2015, and an ITB controller 2016. The fixing-heater driver 2014 drives a fixing heater and the like of the fixing unit 1019. The ITB controller 2016 rotates the ITB 1011 and detects the ITB home position (ITB-HP).

As described above with reference to FIG. 3, the pre-registration stop control is applicable when the paper-feed starting position is apart from a registration position. As described above with reference to FIG. 4, the pre-registration stop control may be inapplicable when the paper-feed starting position is near the registration position. In the image forming apparatus of this embodiment, the paper feeding from the right-deck paper feeder 1039 in FIG. 1 corresponds to the case where the paper-feed starting position is near the registration position.

Figure 3:
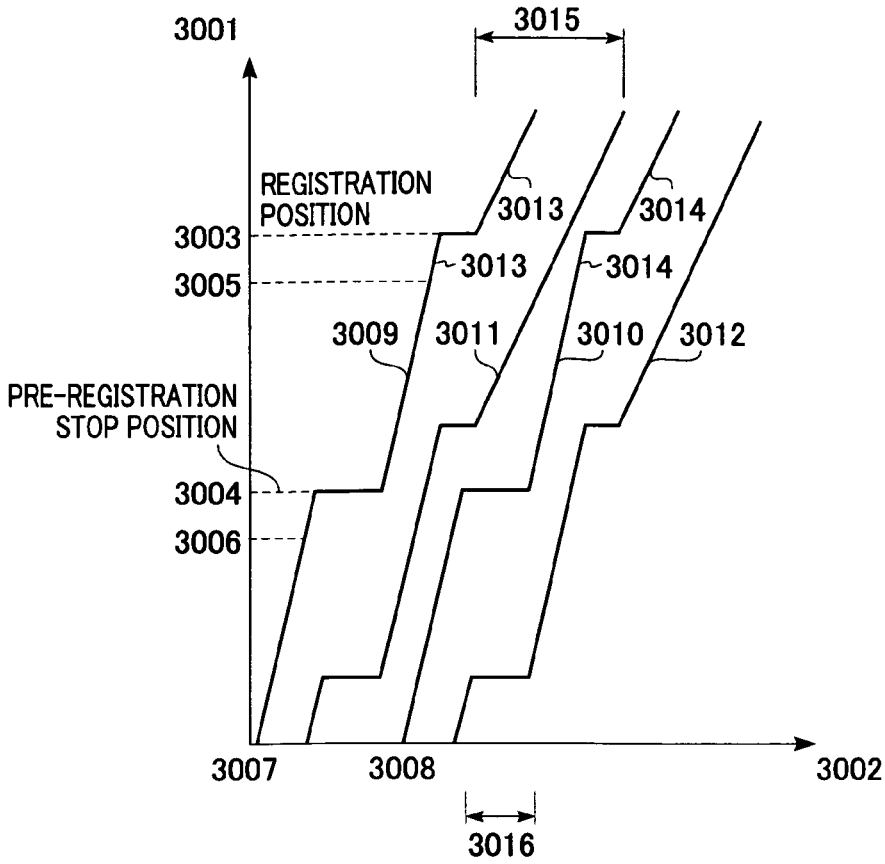
FIG. 3 is a graph showing an example of increased-speed paper feeding and pre-registration stop.
Figure 4:
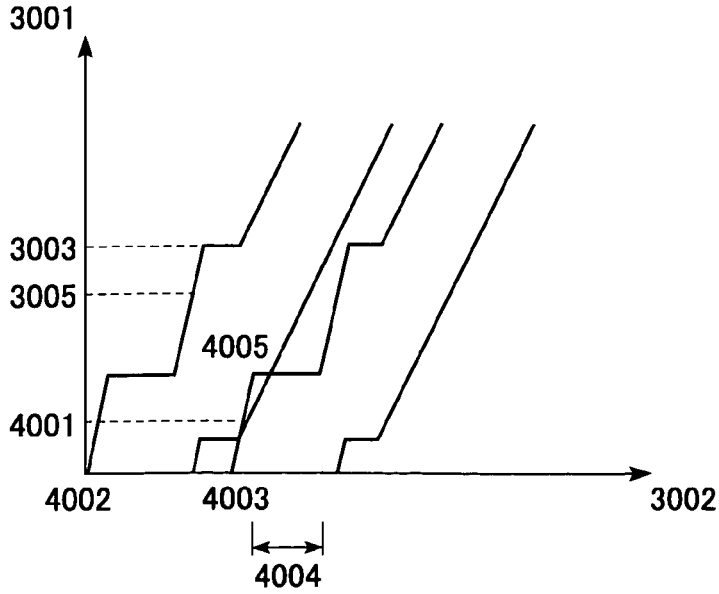
FIG. 4 is a graph showing an example in which pre-registration-stop time period is insufficient.
Figure 5:
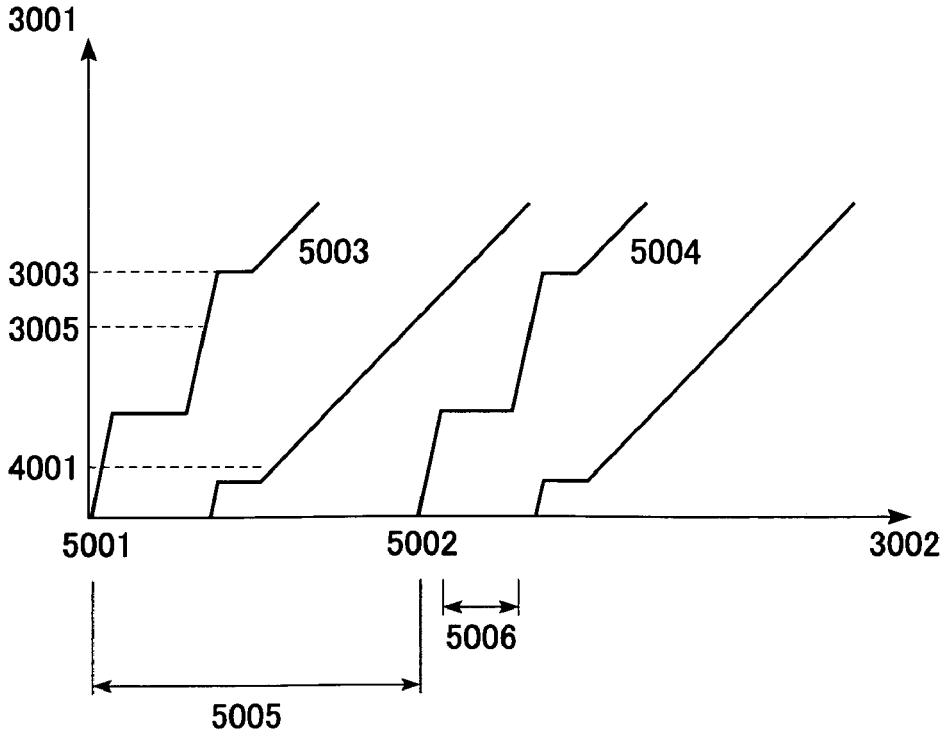
FIG. 5 is a graph showing an example in which decrease in a processing speed makes pre-registration stop applicable.

However, the pre-registration stop control is not always inapplicable when the sheet of paper is fed from the right-deck paper feeder 1039. A case will now be described, with reference to FIG. 5, in which the pre-registration stop control is not inapplicable when the sheet of paper is fed from the right-deck paper feeder 1039. The detailed description of the same parts as in FIGS. 3 and 4 is omitted here. The image forming apparatus sometimes performs printing at a processing speed lower than the processing speed for plain paper. Since an amount of heat that is necessary for thermal fixing is likely to be absorbed by, for example, a thick sheet of paper, the processing speed for the thick sheet of paper that is slower than the processing speed for the plain paper prolongs a time period from a time when the trailing end of a preceding thick sheet passes through the fixing unit 1019 to a time when the head of a subsequent thick sheet arrives at the fixing unit 1019, compared with the corresponding time period for the plain paper sheet, thus facilitating the supply of the amount of heat absorbed into the sheet of paper by the fixing unit 1019. FIG. 5 is a graph showing a state in which the processing speed is slower than that for the plain paper. Referring to FIG. 5, reference numeral 5001 denotes the paper-feed starting time of a preceding sheet of paper and reference numeral 5002 denotes the paper-feed starting time of a subsequent sheet of paper. Segments 5003 and 5004 illustrate paper feeding at the processing speed after registration. The incline of the segments 5003 and 5004 is half of the incline of segments 3013 and 3014 after the registration in FIG. 3, indicating the reduction in the processing speed. At this time, a time interval 5005 in FIG. 5 is set to be longer than the time interval 3015 in FIG. 3 in accordance with the half processing speed, thus ensuring a sufficient pre-registration-stop time period 5006 in FIG. 5, as in 3016 in FIG. 3. In other words, according to this embodiment, it is possible to perform the pre-registration stop control in an image forming job for the thick paper in which the processing speed is lower than it is for the plain paper, even when the sheet of paper is fed from the right-deck paper feeder 1039. The illustrated inclination of the paper-feed speed remains unchanged in FIG. 5, although the processing speed is decreased. It is possible to ensure a sufficient pre-registration-stop time period even when a technology is adopted in which the paper-feed speed is also decreased when the processing speed is decreased.

Figure 6:
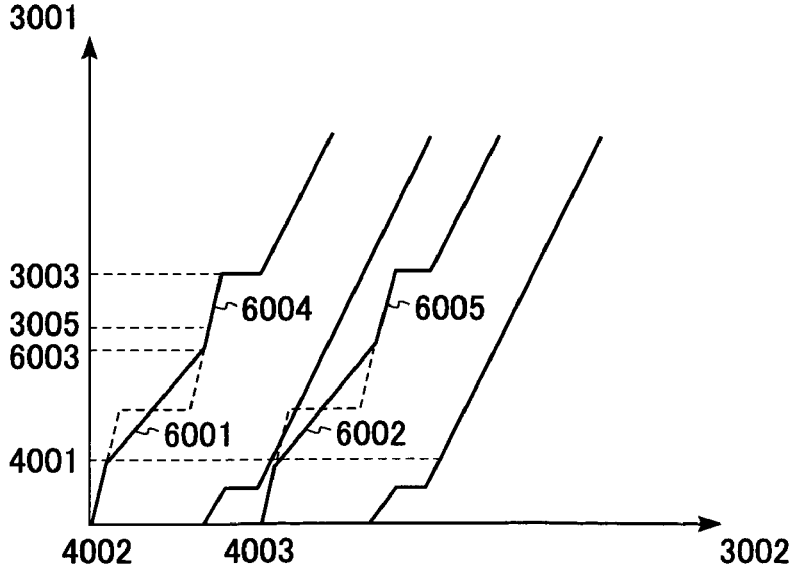
FIG. 6 is a graph showing an example of decreased-speed paper-feed control.

Decreased-speed paper-feed control will now be described, which is substituted for the pre-registration stop control when the pre-registration stop control is inapplicable for feeding the sheet of paper from the right-deck paper feeder 1039, that is, when an image is formed at the processing speed for the plain paper. FIG. 6 is a graph showing a case in which the fed sheet of paper is carried to the registration position in the decreased-speed paper-feed control. The detailed description of the same parts as in FIGS. 3 and 4 is omitted here. Referring to FIG. 6, reference numeral 4002 denotes the paper-feed starting time of a preceding sheet of paper and reference numeral 4003 denotes the paper-feed starting time of a subsequent sheet of paper, as in FIG. 4. The time interval between the times 4002 and 4003 is the same as in FIGS. 3 and 4. When the image forming apparatus starts feeding a sheet of paper, the sheet of paper is carried in the same increased-paper-feed speed as in FIG. 3. When a vertical-path upper sensor, which is a decreased-speed reference sensor, detects the leading end of the sheet of paper at a position 4001, the speed at which the sheet of paper is carried is decreased to a decreased paper-feed speed shown in segments 6001 and 6002. The vertical-path upper sensor corresponds to the reference sensor 1043 in FIG. 1. Reference numeral 6003 denotes a paper-feed-speed return position that is provided upstream of the pre-registration sensor 1015. When the leading end of the sheet of paper arrives at the paper-feed-speed return position, the speed at which the sheet of paper is carried returns to the increased-paper-feed speed in segments 6004 and 6005 in FIG. 6. The decreased paper-feed speed is calculated based on an estimated time when the sheet of paper will arrive at the paper-feed-speed return position and a time when the sheet of paper actually arrives at the decreased-speed reference sensor. The paper-feed-speed return position is determined from the paper-feed starting position. The sheet of paper arrives at the paper-feed-speed return position according to schedule at the decreased paper-feed speed.

In other words, the sheet of paper can arrive at the paper-feed-speed return position within a differential time at the decreased paper-feed speed (a second paper-feed speed). The differential time can be calculated by taking a measured time period from the paper-feed starting time to a time when the reference sensor is turned on, and subtracting that measured time period from a predetermined time period during which the leading end of the sheet of paper fed from the paper-feed starting position arrives at the paper-feed-speed return position.

Since the paper-feed starting times 4002 and 4003 do not lag in the decreased-speed paper-feed control in FIG. 6, without the leading end of the subsequent sheet of paper impinging against the trailing end of the preceding sheet of paper, unlike in FIG. 4, the delay due to slip during paper feeding can be eliminated. In addition, since the sheet of paper is carried at the increased-paper-feed speed after the paper-feed-speed return position, the leading end of the sheet of paper is detected by the pre-registration sensor 1015 at the same speed as in FIG. 3. Hence, the leading end of the sheet of paper impinges against the registration rollers 1017 in the same state both in the decreased-speed paper-feed control and in the pre-registration stop control.

Figure 7:
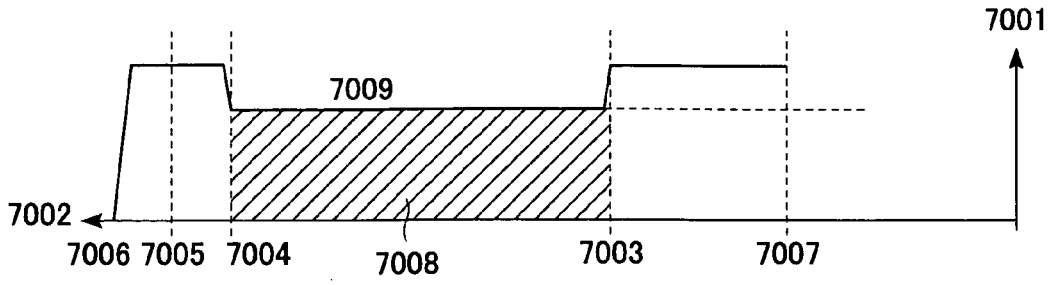
FIG. 7 is a graph showing a transition of the speed of a sheet of paper in the decreased-speed paper-feed control.

FIG. 7 is a graph showing a transition of the speed of a sheet of paper in the decreased-speed paper-feed control. A vertical axis 7001 represents the speed of a sheet of paper. A horizontal axis 7002 represents transit time from right to left. Reference numeral 7007 denotes a paper-feed starting time. Reference numeral 7003 denotes a time when the leading end of the sheet of paper is detected by the vertical-path upper sensor 1043, which is a decreased-speed reference sensor. Reference numeral 7004 denotes a time when the sheet of paper arrives at the paper-feed-speed return position. Reference numeral 7005 denotes a time when the leading end of the sheet of paper is detected by the pre-registration sensor 1015. Reference numeral 7006 denotes a time when the leading end of the sheet of paper impinges against the registration rollers 1017 and the sheet of paper stops. The determined paper-feed starting time 7007 uniquely determines the time 7004 when the sheet of paper arrives at the paper-feed-speed return position, that is, an ideal time period for feeding and carrying the sheet of paper. However, the time period from 7007 to 7003 varies for every sheet of paper due to slippage during paper feeding. As a result, the transition time from 7003 to 7004 also varies for every sheet of paper. In contrast, since the distance from the decreased-speed reference sensor 1043 to the paper-feed-speed return position is constant, an area 7008 must be constant. Hence, a decreased paper-feed speed 7009 is determined in accordance with the transition time from 7003 to 7004.

Figure 8:
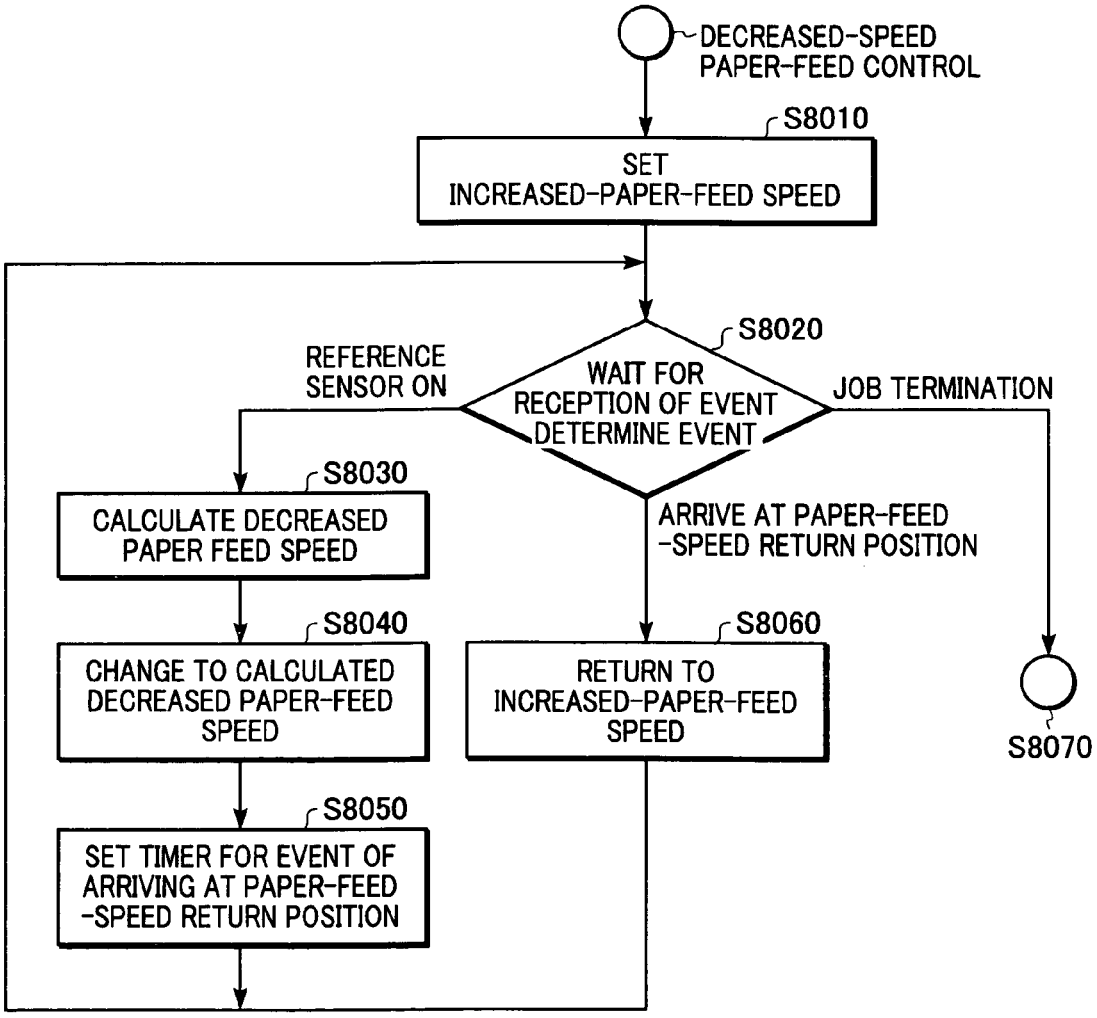
FIG. 8 is a flowchart showing a process of the decreased-speed paper-feed control.

FIG. 8 is a control flowchart from a time when the reference sensor is turned on to a time when the sheet of paper arrives at the paper-feed-speed return position in the decreased-speed paper-feed control.

The process in the flowchart in FIG. 8 is executed by the CPU 2001 shown in FIG. 2. In Step S8010, the paper-feed speed is set to a predetermined increased-paper-feed speed at the beginning of the job. In Step S8020, the process waits for a reception of an event and determines the received event. If an event of turning on the reference sensor in response to the detection of the leading end of the sheet of paper by the decreased-speed reference sensor occurs, the process proceeds to Step S8030 to calculate the decreased paper-feed speed described with reference to FIG. 7.

In Step S8040, the process changes the paper-feed speed to the calculated decreased paper-feed speed. In Step S8050, the process sets a timer for an event of arriving at the paper-feed-speed return position, and goes back to Step S8020. When time is up, the event of arriving at the paper-feed-speed return position occurs. If the event of arriving at the paper-feed-speed return position occurs in Step S8020, the process proceeds to Step S8060 to return the paper-feed speed to the increased-paper-feed speed, and goes back to Step S8020. If a job terminating event occurs in Step S8020, the process proceeds to Step S8070 to exit the flowchart.

Figure 9:
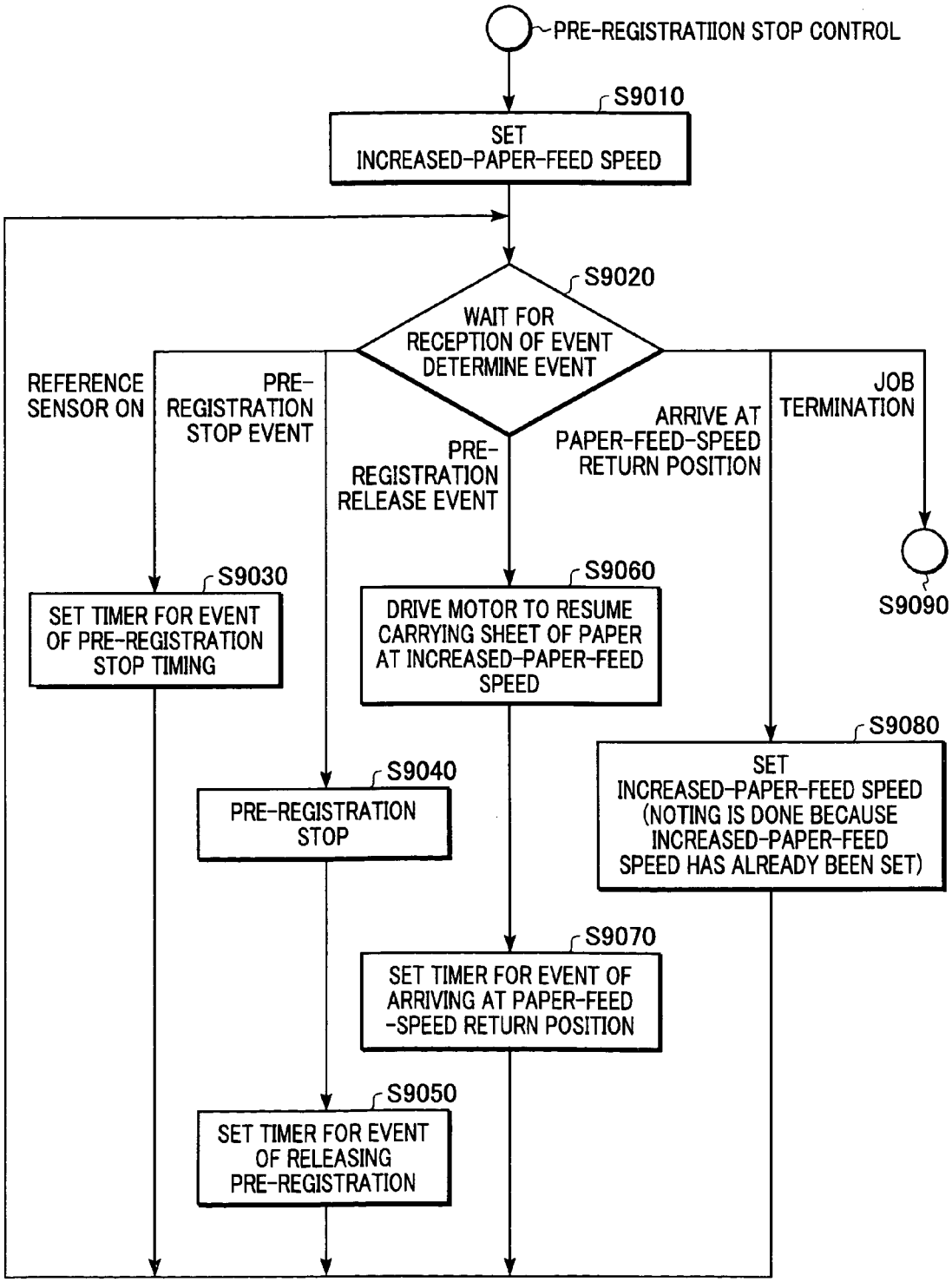
FIG. 9 is a flowchart showing a process of pre-registration stop control.

FIG. 9 is a control flowchart from a time when the reference sensor is turned on to a time when the sheet of paper arrives at the paper-feed-speed return position in the pre-registration stop control. The process in the flowchart in FIG. 9 is executed by the CPU 2001 shown in FIG. 2. In Step S9010, the process sets the paper-feed speed to a predetermined increased-paper-feed speed at the beginning of the job. In Step S9020, the process waits for reception of an event and determines the received event. If the event of turning on the reference sensor in response to the detection of the leading end of the sheet of paper by the reference sensor occurs, the process proceeds to Step S9030 to set the timer for the event of pre-registration stop, and goes back to Step S9020. If the event of pre-registration stop occurs in Step S9020, the process proceeds to Step S9040 to stop carrying the sheet of paper and to suspend the sheet of paper at a pre-registration position. In Step S9050, the process sets a timer for the event of releasing the pre-registration. A pre-registration release time with respect to the start of paper feeding is uniquely determined by the paper feeder and the processing speed. The delay due to slippage in the paper feeder is reflected in the variation in the time when the sheet of paper arrives at a pre-registration stop position. The variation in the pre-registration-stop time period eliminates the delay due to slippage.

In other words, in the pre-registration stop control, starting feeding the sheet of paper at the increased-paper-feed speed (a first paper-feed speed) that is higher than the processing speed and suspending the sheet of paper after a predetermined time after the leading end of the sheet of paper has been detected by the reference sensor achieve the pre-registration stop. The pre-registration time period is the difference between a measured time period from the paper-feed starting time to a time when the reference sensor is turned on, and a predetermined time period from the paper-feed starting time to the pre-registration release time.

After setting the timer for the event of releasing the pre-registration, the process goes back to Step S9020. If a pre-registration release event occurs in Step S9020, then in Step S9060, the process drives the motor to resume carrying the sheet of paper. In Step S9070, the process sets the timer for the event of arriving at the paper-feed-speed return position and goes back to Step S9020. If the event of arriving at the paper-feed-speed return position occurs in Step S9020, the process proceeds to Step 9080 for setting the paper-feed speed to the increased-paper-feed speed. However, in the pre-registration stop control, since the paper-feed speed is originally set to the increased-paper-feed speed, nothing is done and the process goes back to Step S9020. If a job-terminating event occurs in Step S9020, the process proceeds to Step S9090 to exit the flowchart.

Figure 10:
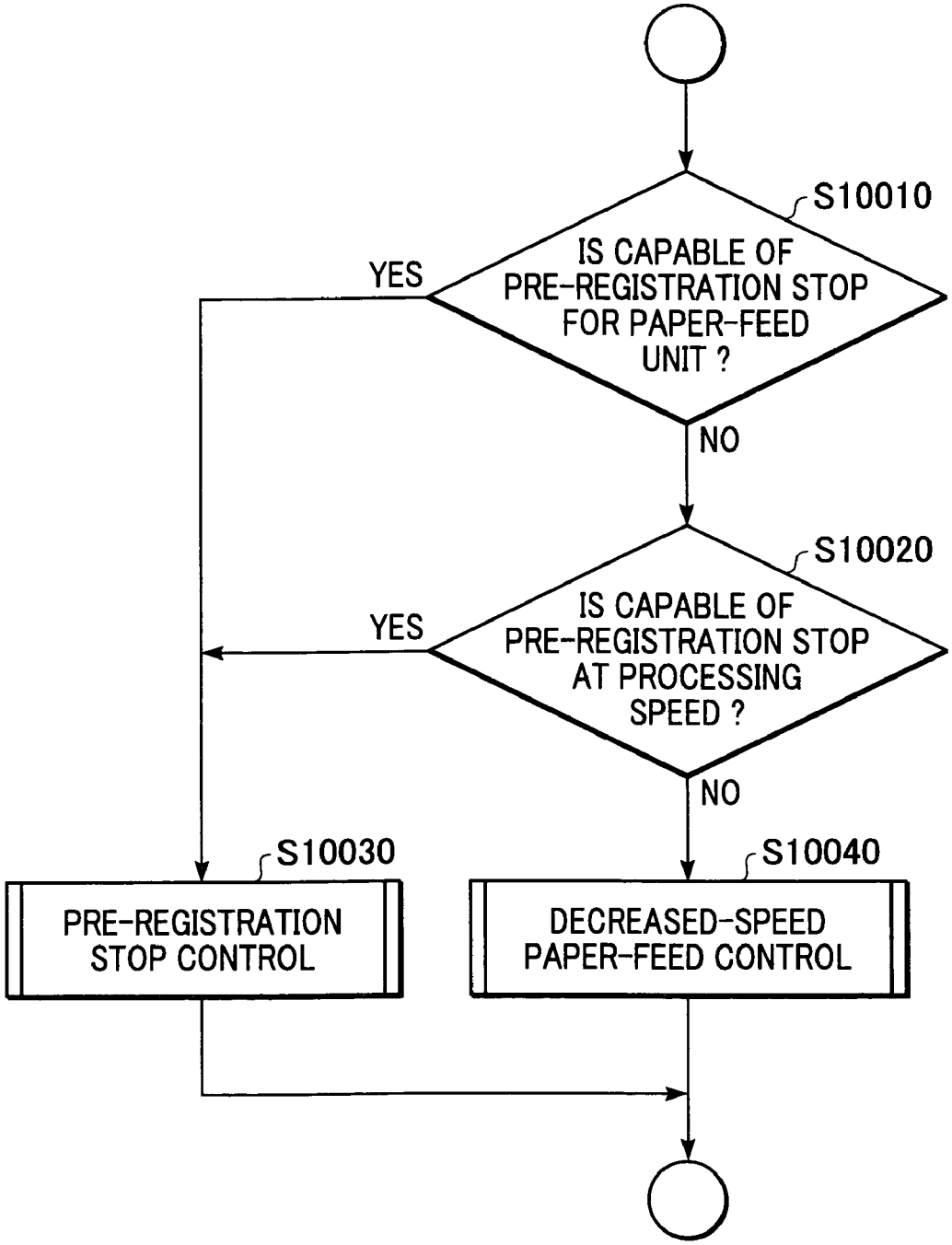
FIG. 10 is a flowchart showing a determination-switching process of the pre-registration stop control and the decreased-speed paper-feed control.

FIG. 10 is a flowchart showing a determination-switching process of the pre-registration stop control and the decreased-speed paper-feed control. The process in the flowchart in FIG. 10 is executed by the CPU 2001 shown in FIG. 2. This process is performed at the start of feeding of each sheet of paper. In Step S10010, the process determines whether the pre-registration stop can be done for the corresponding paper feeder. If the pre-registration stop can be done for the paper feeder, the process proceeds to Step S10030. The process, otherwise, proceeds to Step S10020. In Step S10020, the process determines whether the pre-registration stop can be done at the processing speed and determines the productivity (the intervals in which the sheets of paper are fed). If the pre-registration stop can be done, the process proceeds to Step S10030. The process, otherwise, proceeds to Step S10040. In Step S10030, the pre-registration stop control described with reference to FIG. 9 is performed. In Step S10040, the decreased-speed paper-feed control described with reference to FIG. 8 is performed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

an image former for forming an image on a sheet at a predetermined image-forming speed;

a plurality of feeders, each positioned a different sheet-carrying distance from said image former;

a carrier for feeding and guiding the sheet fed from each of the plurality of feeders to the image former;

a controller for controlling the carrier to suspend feeding of the sheet fed from one of the plurality of feeders at a first position upstream of the image former; and a sensor for detecting the presence or absence of the sheet at a second position upstream of the first position, wherein the controller determines whether feeding a subsequent sheet is suspended at a third position between the first position and the second position based on an output signal from the sensor and controls a speed at which the carrier carries the subsequent sheet, based on at least one of which feeder feeds the sheet from among the plurality of feeders or on the image-forming speed of the image former.

2. An image forming apparatus according to claim 1, wherein the controller determines whether feeding of the subsequent sheet is suspended at the third position based on the output signal from the sensor and controls the speed at which the carrier carries the sheet, based on which feeder feeds the sheet from among the plurality of feeders and on the image-forming speed of the image former.

3. An image forming apparatus according to claim 1, wherein the controller determines whether feeding of the subsequent sheet is suspended at the third position, based on which feeder feeds the sheet from among the plurality of feeders and on the image-forming speed of the image former.

4. An image forming apparatus according to claim 1, wherein the controller controls the speed at which the carrier carries the sheet, based on which feeder feeds the sheet from among the plurality of feeders and on the image-forming speed of the image former.

5. An image forming apparatus according to claim 1, wherein the controller determines whether feeding of the subsequent sheet is suspended at the third position based on the output signal from the sensor and controls the speed at which the carrier carries the sheet, based on which feeder feeds the sheet from among the plurality of feeders.

6. An image forming apparatus according to claim 1, wherein the controller determines whether feeding of the subsequent sheet is suspended at the third position based on which feeder feeds the sheet from among the plurality of feeders.

7. An image forming apparatus according to claim 1, wherein the controller controls the speed at which the carrier carries the sheet based on which feeder feeds the sheet from among the plurality of feeders.

8. An image forming apparatus according to claim 1, wherein the controller determines whether feeding of the subsequent sheet is suspended at the third position based on the output signal from the sensor and controls the speed at which the carrier carries the subsequent sheet, based on the image-forming speed of the image former.

9. An image forming apparatus according to claim 1, wherein the controller determines whether feeding of the subsequent sheet is suspended at the third position based on the image-forming speed of the image former.

10. An image forming apparatus according to claim 1, wherein the controller controls the speed at which the carrier carries the sheet based on the image-forming speed of the image former.

11. An image forming apparatus according to claim 1, wherein, when an image is formed at a first image-forming speed on a sheet fed from a first feeder, the controller suspends feeding of the subsequent sheet at the third position after the controller causes the carrier to carry the subsequent sheet at a first speed and, when the image is formed at the first image-forming speed on a sheet fed from a second feeder having a sheet-carrying distance to the image former that is shorter than that of the first feeder, the controller causes the carrier to carry the subsequent sheet at a second speed lower than the first speed within a predetermined path including the third position without suspending the subsequent sheet at the third position.

12. An image forming apparatus according to claim 11, wherein said controller controls the first feeder and the second feeder so as to feed the subsequent sheet after a first time period followings feeding of a preceding sheet by the first feeder and the second feeder, both when the image is formed at the first image-forming speed on the sheet fed from the first feeder and when the image is formed at the first image-forming speed on the sheet fed from the second feeder.

13. An image forming apparatus according to claim 12, wherein, when the image is formed at the first image-forming speed on the sheet fed from the second feeder, the controller controls the second feeder so as to feed the subsequent sheet after a second time period that is longer than the first time period since the second feeder has fed the preceding sheet, and suspends feeding of the subsequent sheet at the third position after the carrier has carried the subsequent sheet at the first speed.

14. An image forming apparatus according to claim 11, wherein the first speed is higher than the first image-forming speed.

15. An image forming apparatus according to claim 1, wherein the controller causes the image former to form the image on plain paper at a first image-forming speed and to form the image on a thick sheet at a second image-forming speed that is lower than the first image-forming speed.

16. An image forming apparatus according to claim 1, further comprising:

a registration roller provided at the first position, wherein the controller controls the carrier such that the leading end of the sheet impinges against the registration roller that is stopped when feeding of the sheet is suspended at the first position.

* * * * *

UNITED STATES PATENT AND TRADEMARK OFFICE

CERTIFICATE OF CORRECTION

PATENT NO. : 7,237,772 B2
APPLICATION NO. : 10/830012
DATED : July 3, 2007
INVENTOR(S) : Takuya Kawamura It is certified that error appears in the above-identified patent and that said Letters Patent is hereby corrected as shown below:

ON THE TITLE PAGE:
At Item (75), Inventor, "Takuya Kamamura, Tokyo (JP)" should read --Takuya Kawamura, Tokyo (JP)--.

IN THE DRAWINGS:
Sheet No. 6, Figure 9, "PRE-REGISTRATIION" should read --PRE-REGISTRATION--.

COLUMN 9:
Line 61, "Step 9080" should read --Step S9080--.

COLUMN 12:
Line 8, "followings" should read --following--.

Signed and Sealed this

Fifteenth Day of April, 2008

JON W. DUDAS
*Director of the United States Patent and Trademark Office*